US011572890B2

(12) United States Patent
Yuan et al.

(10) Patent No.: US 11,572,890 B2
(45) Date of Patent: Feb. 7, 2023

(54) BLADE AND AXIAL FLOW IMPELLER USING SAME

(71) Applicants: York Guangzhou Air Conditioning and Refrigeration CO., LTD., Qingyuan (CN); Johnson Controls Technology Company, Auburn Hills, MI (US)

(72) Inventors: Bin Yuan, Qingyuan (CN); Li Wang, Qingyuan (CN); Chenggang Wu, Qingyuan (CN); Jian Zhu, Qingyuan (CN)

(73) Assignees: Johnson Controls Tyco IP Holdings LLP, Milwaukee, WI (US); York Guangzhou Air Conditioning and Refrigeration Co., Ltd., Quingyuan (CN)

( * ) Notice: Subject to any disclaimer, the term of this patent is extended or adjusted under 35 U.S.C. 154(b) by 0 days.

(21) Appl. No.: 17/280,111

(22) PCT Filed: Sep. 24, 2019

(86) PCT No.: PCT/CN2019/107444
§ 371 (c)(1),
(2) Date: Mar. 25, 2021

(87) PCT Pub. No.: WO2020/063565
PCT Pub. Date: Apr. 2, 2020

(65) Prior Publication Data

US 2021/0340992 A1 Nov. 4, 2021

(30) Foreign Application Priority Data

Sep. 25, 2018 (CN) ..... 201811119928.6
Sep. 25, 2018 (CN) ..... 201821560173.9

(51) Int. Cl.
*F04D 29/38* (2006.01)
*F04D 29/66* (2006.01)

(52) U.S. Cl.
CPC ..... *F04D 29/384* (2013.01); *F04D 29/666* (2013.01)

(58) Field of Classification Search
CPC .... F04D 29/384; F04D 29/681; F04D 29/667; F05D 2240/303; F05D 2240/304
See application file for complete search history.

(56) References Cited

U.S. PATENT DOCUMENTS 4,089,618 A * 5/1978 Patel ..... F01D 5/141 416/228
2003/0012656 A1 1/2003 Cho et al.

FOREIGN PATENT DOCUMENTS

CN 202391808 U 8/2012
CN 204572556 U 8/2015
(Continued)

OTHER PUBLICATIONS

PCT International Search Report for PCT Application No. PCT/CN2019/107444 dated Dec. 20, 2019, 5 pgs.
(Continued)

*Primary Examiner* — Sabbir Hasan
(74) *Attorney, Agent, or Firm* — Fletcher Yoder, P.C.

(57) ABSTRACT

The present application discloses a blade, comprising a blade tip, a blade root, a leading edge, and a trailing edge, wherein the leading edge and the trailing edge each extend from the blade tip to the blade root; the blade may rotate around a rotation axis, and the rotation axis and a normal plane of the rotation axis perpendicularly intersect at the foot of the perpendicular; a projection of the leading edge on the normal plane along the rotation axis is a first curve, and the first curve has an even number of inflection points. The blade
(Continued)

of the present application can reduce noise and improve aerodynamic performance when the blade rotates.

14 Claims, 9 Drawing Sheets

(56) References Cited

FOREIGN PATENT DOCUMENTS

| | | | | | |
|---|---|---|---|---|---|
| CN | 206626017 | U | | 11/2017 | |
| CN | 108087308 | A | | 5/2018 | |
| CN | 207333287 | U | | 5/2018 | |
| CN | 108350904 | A | * | 7/2018 | ..... F04D 29/30 |
| CN | 108350904 | A | | 7/2018 | |
| CN | 209012127 | U | | 6/2019 | |
| EP | 3343045 | A1 | | 7/2018 | |
| JP | 2017070337 | A | | 4/2017 | |

OTHER PUBLICATIONS

European Search Report for EP Application No. 19865164.8, dated May 18, 2022, 12 pgs.

* cited by examiner

BLADE AND AXIAL FLOW IMPELLER USING SAME

CROSS-REFERENCE TO RELATED APPLICATIONS

This application is a U.S. National Stage Application of PCT Application No. PCT/CN2019/107444, entitled "BLADE AND AXIAL FLOW IMPELLER USING SAME," filed Sep. 24, 2019, which claims priority to and the benefit of Chinese Patent Application No. 201811119928.6, filed Sep. 25, 2018, and Chinese Utility Model Application No. 201821560173.9, filed Sep. 25, 2018, each of which is herein incorporated by reference in its entirety for all purposes.

TECHNICAL FIELD

The present application relates to the field of rotating machines, such as fans, pumps, and compressors, and more specifically to a blade and an axial flow impeller that uses the same.

BACKGROUND ART

The leading edge and trailing edge of a conventional blade have monotone smooth curves. Due to the serious flow separation on the surface of the blade, vortices are formed, and consequently the blade produces low aerodynamic performance and high noise.

SUMMARY OF THE INVENTION

Exemplary embodiments of the present application can solve at least some of the above-mentioned problems.

According to a first aspect of the present application, the present application provides a blade, comprising a blade tip, a blade root, a leading edge, and a trailing edge, wherein the leading edge and the trailing edge each extend from the blade tip to the blade root; the blade may rotate around a rotation axis, and the rotation axis and a normal plane of the rotation axis perpendicularly intersect at the foot of the perpendicular; a projection of the leading edge on the normal plane along the rotation axis is a first curve, and the first curve has an even number of inflection points.

In the blade according to the first aspect described above, the number of inflection points is 2, 4 or 6.

In the blade according to the first aspect described above, the number of the inflection points is selected such that formation of vortices is reduced.

In the blade according to the first aspect described above, the line connecting any point on the first curve and the foot of the perpendicular is a first line; the line connecting a projection point of the intersection of the blade root and the leading edge on the normal plane along the rotation axis and the foot of the perpendicular is a second line; an included angle between the first line and the second line is called a wrap angle $\theta$; and the wrap angle $\theta$ of any point on the first curve satisfies $\theta \in [0°, 40°]$.

In the blade according to the first aspect described above, the trailing edge is provided with a plurality of grooves.

In the blade according to the first aspect described above, a projection of the trailing edge on the normal plane along the rotation axis is a second curve, wherein an included angle between the groove walls of each groove is $\alpha$, the groove depth is H, and the length of the second curve is L; the included angle and the groove depth satisfy: $\alpha \in [10°, 100°]$; $H = K \times L$, $K \in [1.5\%, 20\%]$; and a projection point of the intersection of the blade tip and the trailing edge on the normal plane along the rotation axis is located on the groove wall.

In the blade according to the first aspect described above, the intervals between the plurality of grooves are the same.

In the blade according to the first aspect described above, the opening widths of the plurality of grooves are the same, and the groove depths increase by equal difference.

In the blade according to the first aspect described above, the bottom of each of the plurality of grooves is arc-shaped.

According to a second aspect of the present application, the present application provides an axial flow impeller, comprising a hub, the hub having a rotation axis, the hub being able to rotate around the rotation axis; and at least two blades, the at least two blades being arranged on an outer circumferential face of the hub; each of the at least two blades comprises a blade tip, a blade root, a leading edge, and a trailing edge, wherein the leading edge and the trailing edge each extend from the blade tip to the blade root; the blade may rotate around a rotation axis, and the rotation axis and a normal plane of the rotation axis perpendicularly intersect at the foot of the perpendicular; a projection of the leading edge on the normal plane along the rotation axis is a first curve, and the first curve has an even number of inflection points.

According to a third aspect of the present application, the present application provides a blade, comprising a blade tip, a blade root, a leading edge, and a trailing edge, wherein the leading edge and the trailing edge each extend from the blade tip to the blade root; and the trailing edge of the blade is provided with a plurality of grooves.

In a blade according to the third aspect described above, the blade may rotate around a rotation axis, and the rotation axis and a normal plane of the rotation axis perpendicularly intersect at the foot of the perpendicular; a projection of the trailing edge on the normal plane along the rotation axis is a second curve, wherein an included angle between the groove walls of each groove is $\alpha$, the groove depth is H, and the length of the second curve is L; the included angle and the groove depth satisfy: $\alpha \in [10°, 100°]$; $H = K \times L$, $K \in [1.5\%, 20\%]$; and a projection point of the intersection of the blade tip and the trailing edge on the normal plane along the rotation axis is located on the groove wall.

In the blade according to the third aspect described above, the intervals between the plurality of grooves are the same.

In the blade according to the third aspect described above, the opening widths of the plurality of grooves are the same, and the groove depths increase by equal difference.

In the blade according to the third aspect described above, the bottom of each of the plurality of grooves is arc-shaped.

According to a fourth aspect of the present application, the present application provides an axial flow impeller comprising a hub, the hub having a rotation axis, the hub being able to rotate about the rotation axis; and at least two blades, the at least two blades being arranged on an outer circumferential face of the hub; each of the at least two blades comprises a blade tip, a blade root, a leading edge, and a trailing edge, wherein the leading edge and the trailing edge each extend from the blade tip to the blade root; and the trailing edge of the blade is provided with a plurality of grooves.

The blade of the present application can reduce noise and improve performance when the blade rotates.

BRIEF DESCRIPTION OF THE DRAWINGS

The features and advantages of the present application can be better understood by reading the following detailed description with reference to the drawings. In all of the drawings, identical reference labels indicate identical components, wherein.

SPECIFIC EMBODIMENTS

Figure 1:
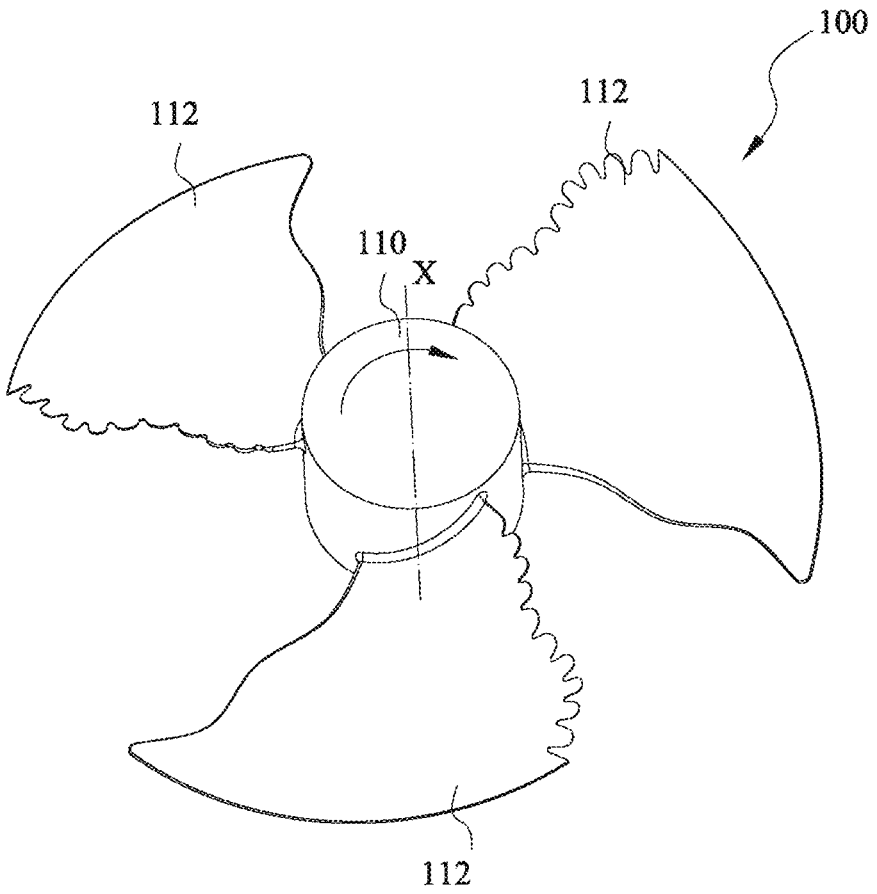
FIG. 1 shows a three-dimensional drawing of an impeller using the blade in an embodiment of the present application.

Various specific embodiments of the present application will be described below with reference to the drawings which form a part of this description. In the following drawings, identical parts and components are indicated by identical reference numerals, and similar parts and components are indicated by similar reference numerals.

FIG. 1 shows a three-dimensional drawing of an impeller 100 using the blade in an embodiment of the present application. As shown in FIG. 1, the impeller 100 comprises a hub 110 and three blades 112. The hub 110 has a rotation axis X. A cross section of the hub 110 perpendicular to the rotation axis X is circular. Three blades 112 are evenly arranged on an outer circumferential face of the hub 110 and are integrally connected to the blade 112. The hub 110 and the blades 112 may rotate about the rotation axis X together. As an example, the impeller 100 of the present application rotates around the rotation axis X clockwise (that is, in the rotation direction indicated by the arrow in FIG. 1). Those of ordinary skill in the art can understand that the hub 110 may also have another shape, and the number of blades 112 may be at least two. The hub 110 may be shaped in accordance with the number of blades 112. For example, when the number of blades 112 is three, a cross section of the hub 110 perpendicular to the rotation axis X is triangular; when the number of blades 112 is four, a cross section of the hub 110 perpendicular to the rotation axis X is quadrilateral.

Figure 2:
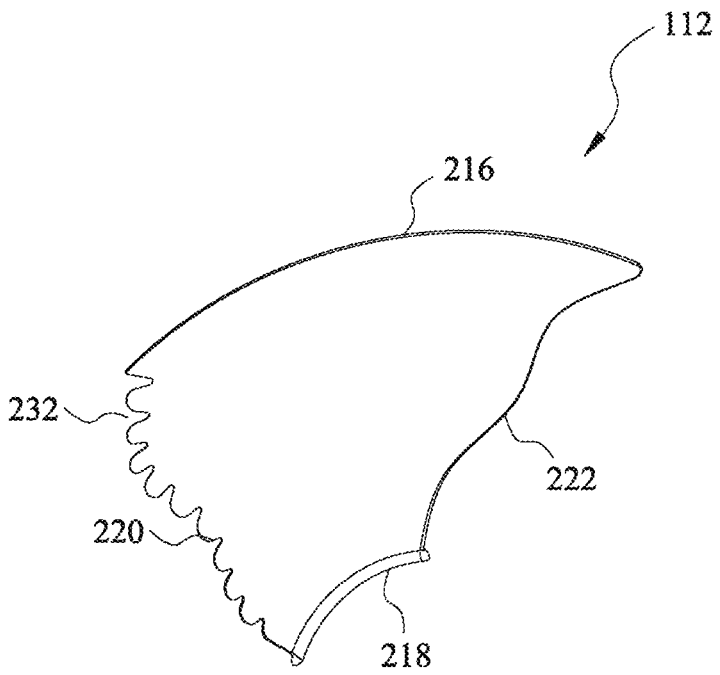
FIG. 2 shows a three-dimensional drawing of the blade used in the impeller in FIG. 1.

FIG. 2 shows a three-dimensional drawing of the blade 112 used in the impeller 100 in FIG. 1. As shown in FIG. 2, the blade 112 comprises an upper surface, a lower surface, a blade tip 216, a blade root 218, a leading edge 222, and a trailing edge 220. "Leading edge 222" refers to the front-end edge in the direction of blade rotation. "Trailing edge 220" refers to the rear-end edge in the direction of blade rotation. "Blade root 218" refers to an edge where the blade and the hub intersect. "Blade tip 216" refers to the other edge opposite to the blade root. The upper surface and the lower surface each extend from the blade tip 216 to the blade root 218, and also each extend from the leading edge 222 to the trailing edge 220. The trailing edge 220 of the blade 112 of the present application is provided with a plurality of grooves 232, the plurality of grooves 232 each extending towards the leading edge 222.

Figure 3A:
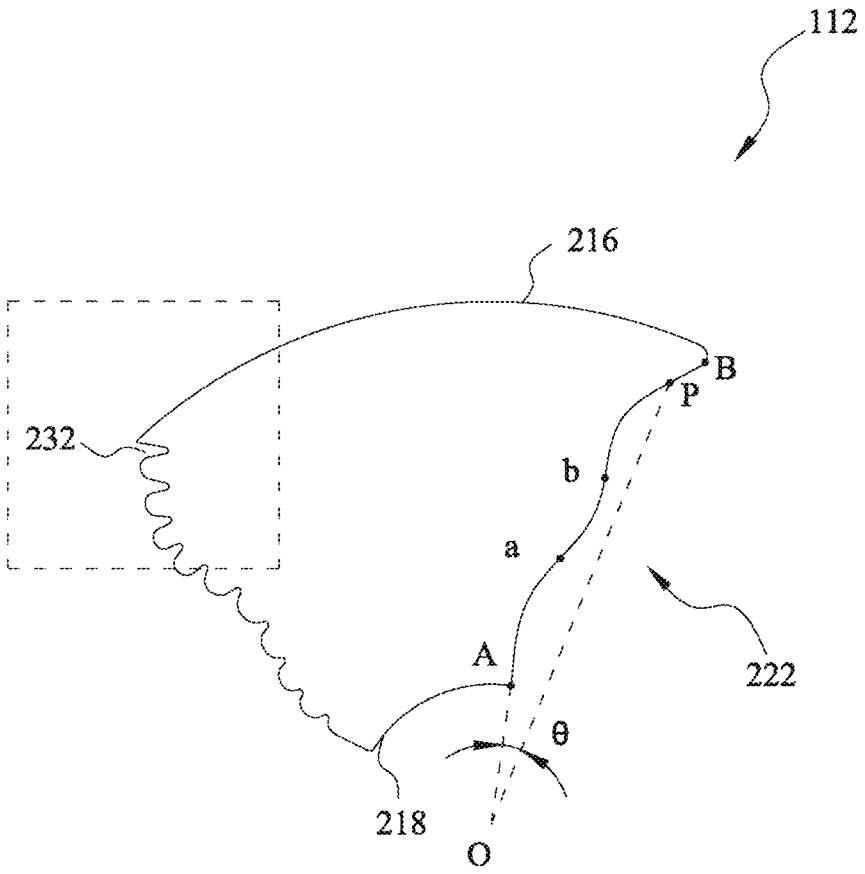
FIG. 3A shows a projection of the blade in FIG. 1 on a normal plane along a rotation axis X.
Figure 3B:
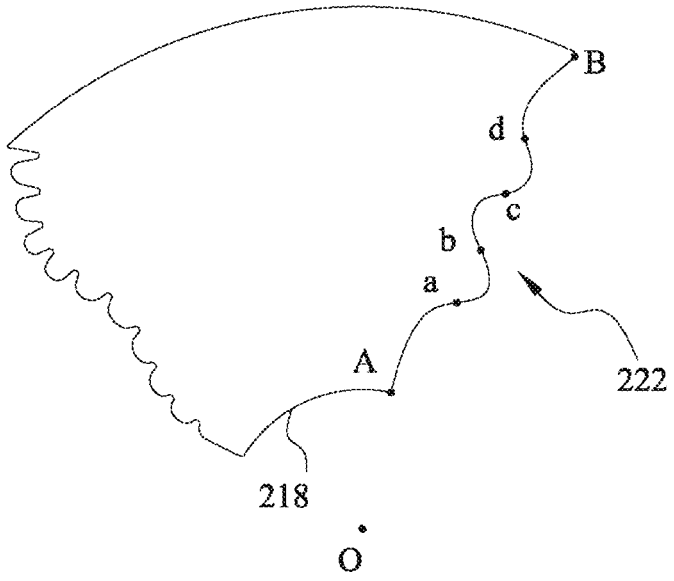
FIG. 3B shows a projection of the blade on a normal plane along the rotation axis X according to another embodiment of the present application.
Figure 3C:
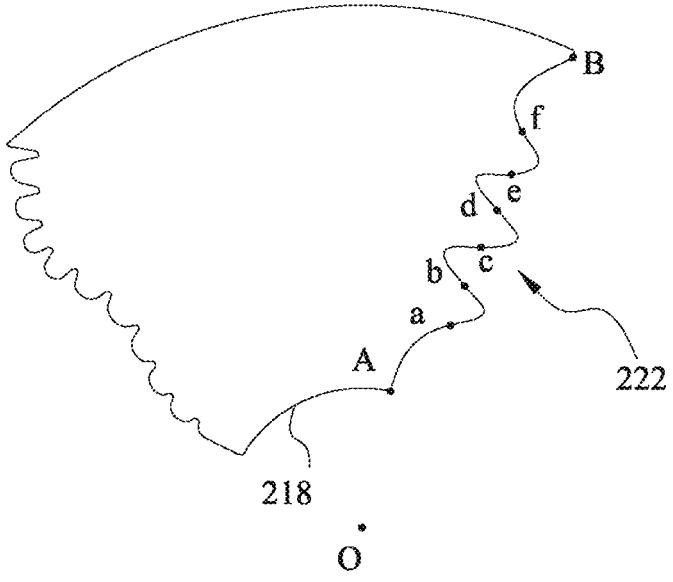
FIG. 3C shows a projection of the blade on a normal plane along the rotation axis X according to still another embodiment of the present application.

The impeller 100 is provided with a normal plane (not shown) that is perpendicular to the rotation axis X, and the rotation axis X and the normal plane perpendicularly intersect at the foot of the perpendicular O (see FIGS. 3A-3C). Those of ordinary skill in the art can understand that the normal plane is a virtual plane intended to better illustrate the specific structure of the leading edge 222 and that of the trailing edge 220 of the blade 112. A projection of the leading edge 222 of the blade 112 of the present application on the normal plane along the rotation axis X is a first curve, wherein the first curve has an even number of inflection points. The inflection points are demarcation points between concave arcs and convex arcs.

FIG. 3A shows a projection of the blade 112 in FIG. 1 on a normal plane along a rotation axis X. As shown in FIG. 3A, the first curve has two inflection points: inflection point a and inflection point b. A point of projection of the intersection point of the blade root 218 and the leading edge 222 on a normal plane along the rotation axis X is point A, and a point of projection of the intersection point of the blade tip 216 and the leading edge 222 on a normal plane along the rotation axis X is point B. The curve from point A to inflection point a and the curve from inflection point b to point B are concave arcs; the curve from inflection point a to inflection point b is a convex arc. Point P is any point on the first curve, and the line connecting point P and the foot of the perpendicular O is a first line. The line connecting point A and the foot of the perpendicular O is a second line. An included angle between the first connection line and the second connection line is a wrap angle θ. In an embodiment of the present application, the wrap angle θ at any point P on the first curve satisfies $\theta \in [0°, 40°]$, and any line connecting any point P on the first curve and the foot of the perpendicular O is on the same side of the second line.

FIG. 3B shows a projection of the blade on a normal plane along the rotation axis X according to another embodiment of the present application. As shown in FIG. 3B, the first curve has four inflection points: inflection point a, inflection point b, inflection point c, and inflection point d. The curve from point A to inflection point a, the curve from inflection point b to inflection point c, and the curve from inflection point d to point B are concave arcs; the curve from inflection point a to inflection point b and the curve from inflection point c to inflection point d are convex arcs.

FIG. 3C shows a projection of the blade on a normal plane along the rotation axis X according to still another embodiment of the present application. As shown in FIG. 3C, the first curve has six inflection points: inflection point a, inflection point b, inflection point c, inflection point d, inflection point e, and inflection point f. The curve from point A to inflection point a, the curve from inflection point b to point inflection point c, the curve from inflection point d to inflection point e, and the curve from inflection point f to point B are concave arcs; the curve from inflection point a to inflection point b, the curve from inflection point c to inflection point d, and the curve from inflection point e to inflection point f are convex arcs.

The wrap angle θ at any point on the first curve in FIGS. 3B and 3C also satisfies θ∈[0°, 40°], and any line connecting any point P on the first curve and the foot of the perpendicular O is on the same side of the second line.

It should be noted that a first curve in the present application refers to a projection of the front edge 222 on a normal plane along the rotation axis X, which does not mean that a curve with a specific shape is a first curve.

Figure 4A:
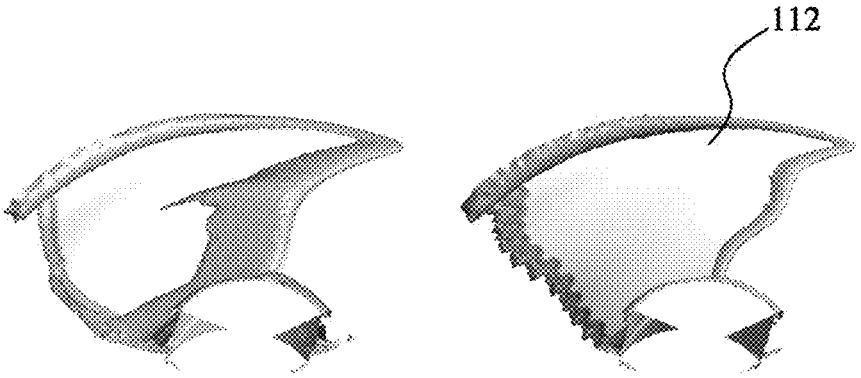
FIGS. 4A and 4B respectively show a comparison of a conventional blade and a blade of the present application in terms of vortex distribution and flow lines on the upper surface of the blade.
Figure 4B:
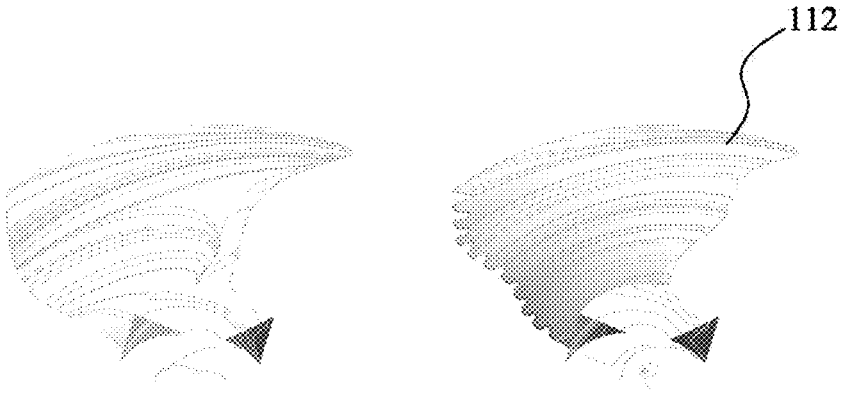

FIGS. 4A and 4B respectively show a comparison of a conventional blade (a blade with which a curve of a projection of the leading edge on a normal plane along the rotation axis X has no inflection points; in other words, a curve of a projection of the leading edge on a normal plane along the rotation axis X is a monotone smooth curve) and the blade 112 of the present application in terms of vortex distribution and flow lines on the upper surface of the blade. In FIGS. 4A and 4B, the blade on the left is a conventional blade, and the blade on the right is the blade 112 of the application. The leading edge 222 in the present application is provided with concave arcs and convex arcs to increase the work length of the leading edge 222, thereby allowing a reduction of the load on the leading edge 222 of the blade 112. When the blade 112 rotates, the concave arcs and convex arcs on the leading edge 222 can forcibly split a large peeling vortex that originally gathered on the upper surface of the blade 112 near the leading edge 222 into at least two smaller vortices (as shown in FIG. 4A), thereby allowing a reduction of the intensity of turbulence and of the dissipation loss caused by turbulence to improve aerodynamic performance while reducing noise. Splitting a vortex into smaller ones may also prevent the blade from being torn up when rotating at a high speed due to the existence of a large peeling vortex, thereby increasing the operating reliability of the blade. In addition, when the concave arcs and convex arcs on the leading edge 222 are split into smaller peeling vortices that are propagated towards the trailing edge 220, they are not prone to mutual movement in the radial direction of the blade 112 to cause secondary flows, and the relative velocity of the air on the surface of the blade 112 ensures that flow lines cross as little as possible (as shown in FIG. 4B), so as to improve the aerodynamic performance while reducing noise.

Figure 5:
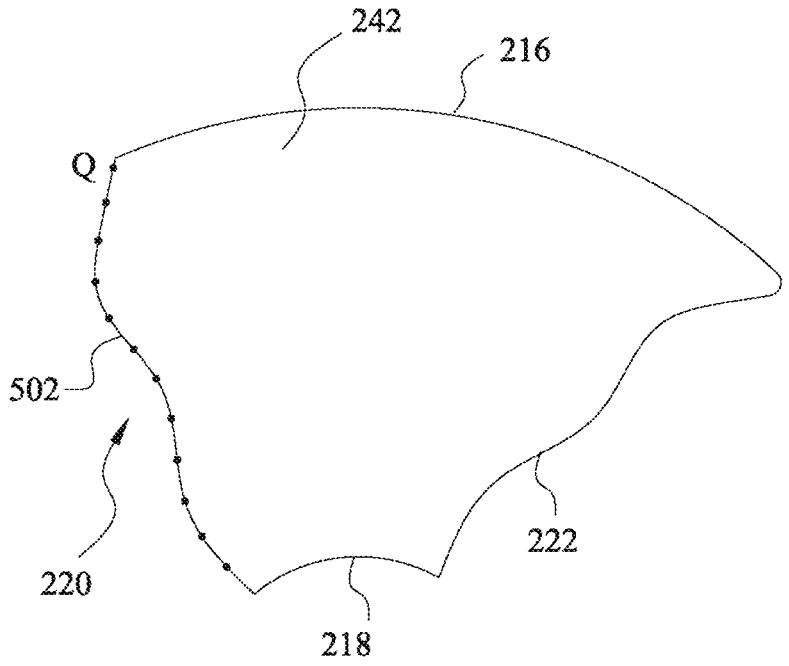
FIG. 5 shows a projection of the blade on a normal plane along the rotation axis X.

FIG. 5 is a projection of the blade 112 on a normal plane along the rotation axis X to show a plurality of distribution points Q of the grooves 232. As shown in FIG. 5, the trailing edge 220 has a contour line 502. The trailing edge 220 is provided with a plurality of grooves 232, each groove has a distribution point Q, and the distribution point Q of each groove is located on the contour line 502. As an example, the intervals between the distribution points Q of the grooves 232 are the same.

Figure 6A:
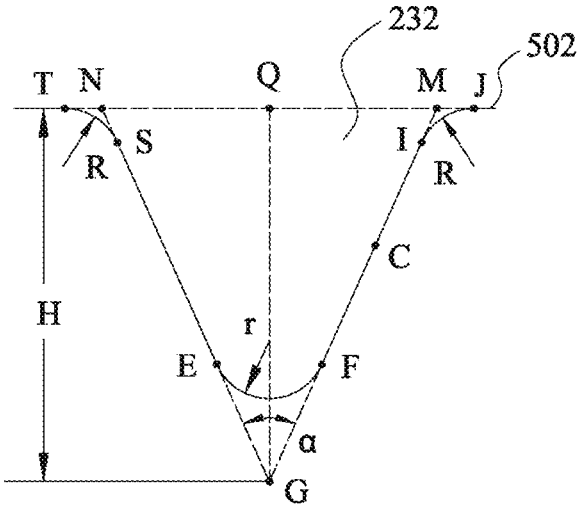
FIG. 6A shows an enlarged projection of the groove shown in FIG. 3A on the normal plane along the rotation axis X.

FIG. 6A is an enlarged projection of a groove 232 shown in FIG. 3A on a normal plane along the rotation axis X to show the specific structure of the groove 232. As shown in FIG. 6A, a projection of the trailing edge 220 on a normal plane along the rotation axis X is a second curve, and the length of the second curve is L. As an example, a straight line perpendicular to the contour line 502 is drawn at the distribution point Q, and the position of the bottom point G is determined according to the groove depth H, wherein the groove depth H satisfies:

$$H=K\times L, K\in[1.5\%,20\%].$$

The groove wall line NG and the groove wall line MG form an included angle α, and the included angle α satisfies:

$$\alpha\in[10°,100°].$$

MN is the opening width of the groove 232. The groove bottom EF is arc-shaped, and its radius is r. The groove bottom EF is tangent to the groove wall line NG and the groove wall line MG at points E and F, respectively. The radius r satisfies $$r\in\left[\frac{1}{25}H,\ \frac{1}{5}H\right].$$

In addition, the first connecting portion ST of the groove wall line NG and of the contour line 502 and the second connecting portion IJ of the groove wall line MG and of the contour line 502 are also arc-shaped, having a radius of R. The first connecting portion ST is tangent to the groove wall line NG and the contour line 502 at points S and T; respectively; The second connecting portion IJ is tangent to the groove wall line MG and the contour line 502 at points I and J, respectively. The radius R satisfies $$R\in\left[\frac{1}{25}H,\ \frac{1}{5}H\right].$$

The first connection part ST, the groove wall SE, the groove bottom EF, the groove wall FI, and the second connection part IJ form a groove 232. The point C is a point of projection of the intersection point of the blade tip 216 and the trailing edge 220 on a normal plane along the rotation axis X, and the projection point C is located on the groove wall FI.

Those of ordinary skill in the art can understand that the groove 232 may not have the first connecting portion ST or the second connecting portion IJ, and that the radius R of the first connecting portion ST or that of the second connecting portion IJ may also be different.

As another example, the straight line QG, instead of being perpendicular to the contour line 502, may face the blade tip 216, the blade root 218, or the leading edge 222.

Figure 6B:
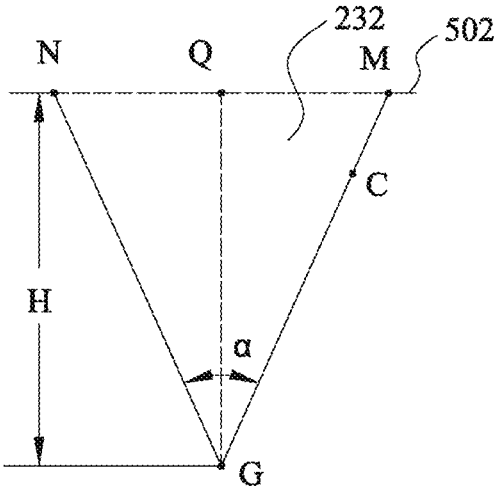
FIG. 6B shows an enlarged projection of the groove on the normal plane along the rotation axis X according to another embodiment of the present application.

FIG. 6B shows an enlarged projection of the groove 232 on a normal plane along the rotation axis X according to another embodiment of the present application. The embodiment shown in FIG. 6B is different from the embodiment shown in FIG. 6A in that the groove 232 is not provided with the first connecting portion ST, the groove bottom EF, or the second connecting portion IJ. The groove wall NG and the groove wall MG form a groove 232. The point C is a point of projection of the intersection point of the blade tip 216 and the trailing edge 220 on a normal plane along the rotation axis X, and the projection point C is located on the groove wall MG.

Figure 7:
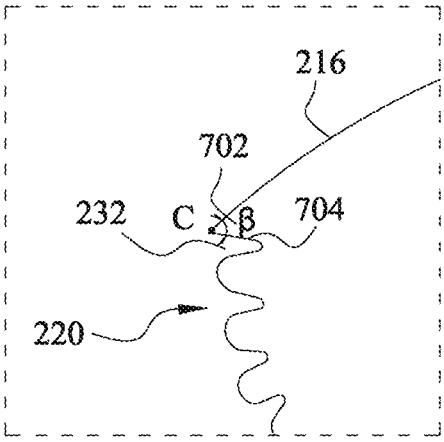
FIG. 7 shows a partial enlarged view of FIG. 3A.

FIG. 7 is a partial enlarged view of FIG. 3A, showing the structure at the intersection of the blade tip 216 and the trailing edge 220. As shown in FIG. 7, the groove wall 704 of the groove 232 closest to the blade tip 216 forms a tip 702 with the blade tip 216. The included angle between the blade tip 216 and the groove wall 704 is β, β satisfying β∈[5°, 80°].

Those of ordinary skill in the art can understand that the opening widths MN of the plurality of grooves 232 on the trailing edge 220 are the same. The groove depth H increases by equal difference from the blade root 218 to the blade tip 216.

See FIGS. 4A and 4B. FIGS. 4A and 4B respectively show a comparison of a conventional blade (a blade whose trailing edge has no grooves; in other words, a curve of a projection of the trailing edge on a normal plane along the rotation axis X is a monotone smooth curve) and the blade 112 of the present application in terms of vortex distribution and flow lines on the upper surface of the blade. As shown in FIG. 4A, when the blade 112 rotates, the peeling vortex will develop into disorderly turbulence at the trailing edge 220, and the turbulence can interact with the grooves 232 on the trailing edge 220, thereby allowing a reduction of scattered noise. Since low-frequency noise may be propagated over a longer distance in the air, the grooves 232 on the trailing edge 220 can effectively reduce low-frequency noise. In addition, the grooves 232 on the trailing edge 220 can also split a large peeling vortex near the trailing edge 220 on the upper surface of the blade 112 into smaller peeling vortices, so as to prevent a large peeling vortex from affecting the inlet airflow of the leading edge 222 of the immediately adjacent blade 112 downstream, thereby preventing deterioration of aerodynamic performance caused by poor inlet conditions. As shown in FIG. 4B, the grooves 232 on the trailing edge 220 can also reduce the secondary flows caused by the mutual movement on the upper surface of the blade 112 in the radial direction, thereby reducing the dissipation loss.

Figure 8:
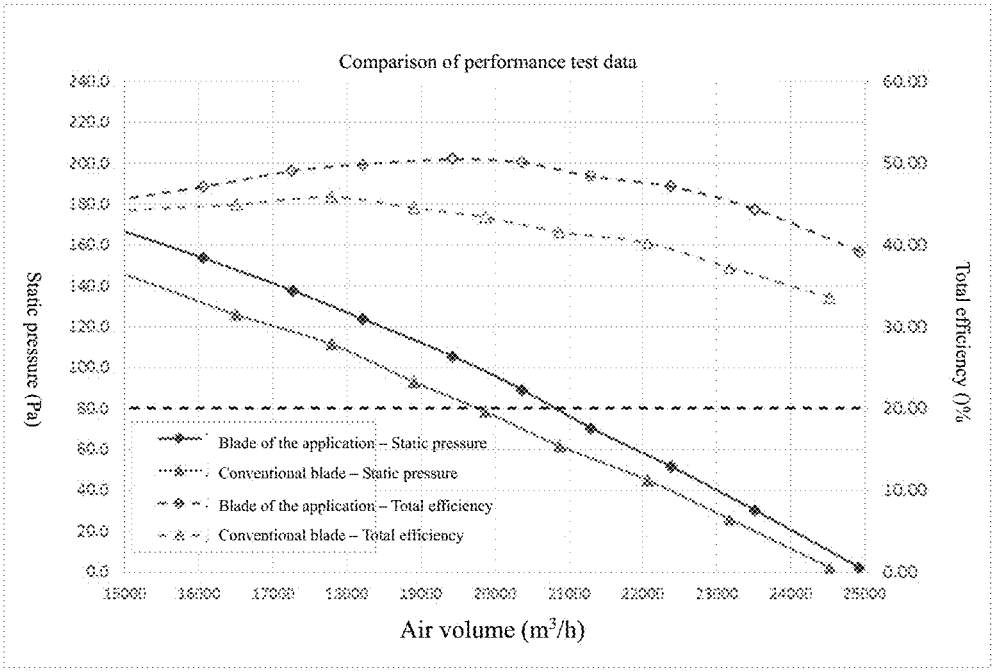
FIG. 8 shows a diagram comparing the blade 112 of the present application and a conventional blade in terms of static pressure and total efficiency.

FIG. 8 shows a diagram comparing the blade 112 of the present application and a conventional blade in terms of static pressure and total efficiency. The dotted lines in FIG. 8 represent the relationship between air volume and total efficiency, and the solid lines represent the relationship between air volume and static pressure. It is clear from FIG. 8 that under the same air volume, the total efficiency of the blade of the present application was higher than that of the conventional blade. Specifically, when the air volume was 19,000 $m^3$/h-25,000 $m^3$/h, the total efficiency of the blade of the present application was about 8% higher than the total efficiency of the conventional blade. In addition, under the same air volume, the static pressure of the blade of the present application was higher than that of the conventional blade. Specifically, when the air volume was 15,000 $m^3$/h-20,000 $m^3$/h, the static pressure of the blade of the present application was about 20 Pa higher than the static pressure of the conventional blade. It is thus clear that the aerodynamic performance (that is, static pressure and total efficiency) of the blade of the present application is better than that of the conventional blade.

Figure 9:
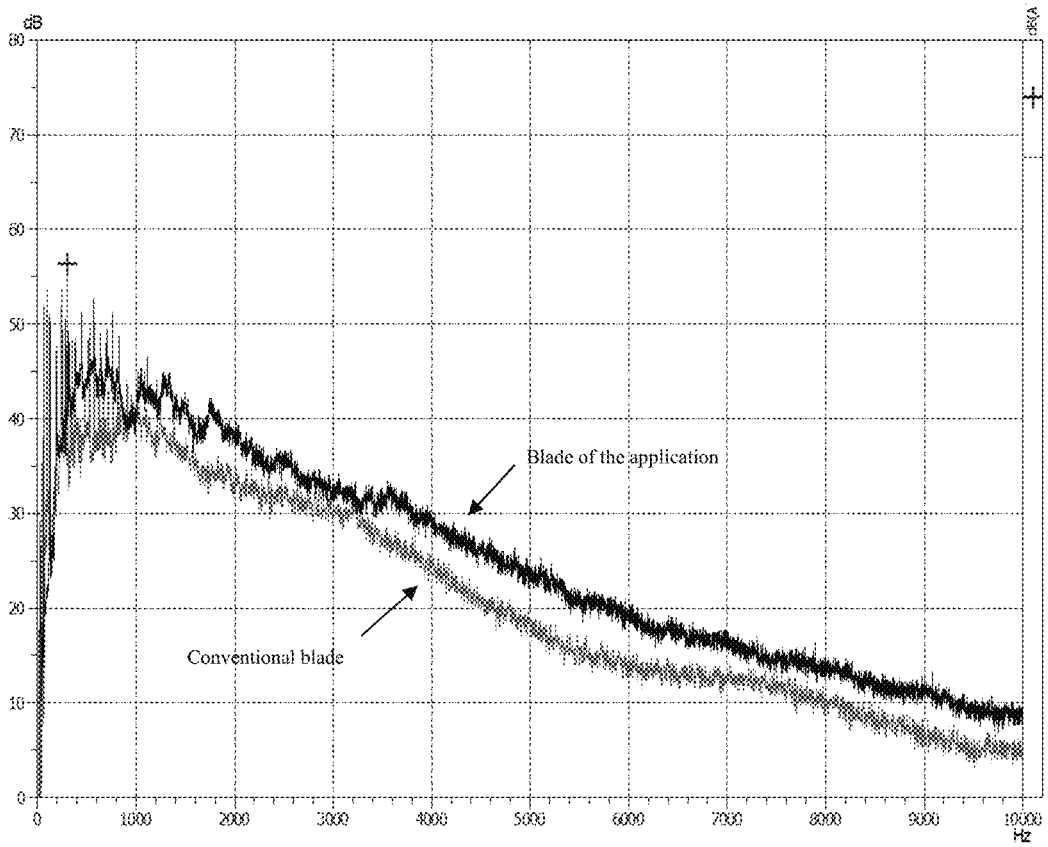
FIG. 9 shows a diagram comparing the blade 112 of the present application and a conventional blade in terms of noise emitted.

FIG. 9 shows a diagram comparing the blade 112 of the present application and a conventional blade in terms of noise emitted. It is clear from FIG. 9 that at a frequency of 1,000 Hz-10,000 Hz, the noise emitted by the conventional blade during operation was about 5 dB higher than the noise emitted by the blade of the present application during operation. In addition, at a frequency of 0 Hz-1,000 Hz, the noise emitted by the blade of the present application during operation was also lower than the noise emitted by the conventional blade during operation. It is thus clear that in the full frequency band, the noise emitted by the blade of the present application was generally lower than the noise emitted by the conventional blade.

It must be explained that a blade profile cross section of the blade 112 from the leading edge to the trailing edge may be of various types; it may be a cross section of equal thickness or any two-dimensional airfoil profile.

Although only some characteristics of the present application are shown and described herein, those skilled in the art can make various improvements and modifications. Therefore, it should be understood that the attached claims are intended to cover all of the above-mentioned improvements and modifications falling within the scope of the substantive spirit of the present application.

The invention claimed is:

1. A blade, comprising:

a blade tip, a blade root, a leading edge, and a trailing edge, wherein the leading edge and the trailing edge each extend from the blade tip to the blade root, the blade is configured to rotate around a rotation axis, and the rotation axis and a normal plane of the rotation axis perpendicularly intersect at an intersection point, wherein a projection of the leading edge on the normal plane along the rotation axis is a first curve, the first curve has an even number of inflection points, the trailing edge comprises a plurality of grooves, and a number of the plurality of grooves is greater than the even number of inflection points.

2. The blade of claim 1, wherein a number of the even number of inflection points is 2, 4, or 6.

3. The blade of claim 1, wherein the leading edge of the blade is configured to reduce formation of vortices.

4. The blade of claim 3, wherein:

a first line connects any point on the first curve and the intersection point;

a second line connects the intersection point and a projection point located at an intersection of the blade root and the leading edge on the normal plane along the rotation axis;

an included angle between the first line and the second line is a wrap angle θ; and the wrap angle θ between the first line and the second line for any point on the first curve satisfies $\theta \in [0°, 40°]$.

5. The blade of claim 1, wherein:

a projection of the trailing edge on the normal plane along the rotation axis is a second curve, wherein an included angle between groove walls of each groove is a, a groove depth of each groove is H, and a length of the second curve is L;

the included angle and the groove depth satisfy:

$$\alpha \in [10°, 100°];$$

$$H = K \times L, K \in [1.5\%, 20°]; \text{ and}$$

a projection point at an intersection of the blade tip and the trailing edge on the normal plane along the rotation axis is located on one of the groove walls.

6. The blade of claim 1, wherein intervals between the plurality of grooves are equal.

7. The blade of claim 1, wherein opening widths of the plurality of grooves are equal, and groove depths of the plurality of grooves increase equally from the blade root to the blade tip.

8. The blade of claim 1, wherein a bottom of each groove of the plurality of grooves is arc-shaped.

9. An axial flow impeller, comprising:

a hub comprising a rotation axis, the hub configured to rotate around the rotation axis; and at least two blades, the at least two blades being arranged on an outer circumferential face of the hub, wherein each blade of the at least two blades comprises:

a blade tip, a blade root, a leading edge, and a trailing edge, wherein the leading edge and the trailing edge each extend from the blade tip to the blade root, the blade is configured to rotate around the rotation axis, and the rotation axis and a normal plane of the rotation axis perpendicularly intersect at an intersection point, wherein the leading edge on the normal plane has an even number of inflection points, and the trailing edge comprises a plurality of grooves, wherein a number of the plurality of grooves is greater than the even number of inflection points.

10. The axial flow impeller of claim 9, wherein a projection of the trailing edge of a respective blade of the at least two blades on the normal plane along the rotation axis is a curve, wherein an included angle between groove walls of each groove of the respective blade is a, a groove depth of each groove of the respective blade is H, and a length of the curve is L;

the included angle and the groove depth satisfy:

$$\alpha \in [10°, 100°];$$

$$H = K \times L, K \in [1.5\%, 20°]; \text{ and}$$

a projection point at an intersection of the blade tip and the trailing edge on the normal plane along the rotation axis is located on one of the groove walls of the respective blade.

11. The axial flow impeller of claim 9, wherein respective intervals between the plurality of grooves of a respective blade of the at least two blades are the same.

12. The axial flow impeller of claim 9, wherein a bottom of each groove of the plurality of grooves of a respective blade of the at least two blades is arc-shaped.

13. The axial flow impeller of claim 9, wherein the even number of inflection points is 2, 4, or 6.

14. The axial flow impeller of claim 9, wherein a projection of the leading edge of a respective blade of the at least two blades on the normal plane along the rotation axis is a curve, wherein:

a first line connects any point on the curve and the intersection point;

a second line connects the intersection point and a projection point located at an intersection of the blade root and the leading edge of the respective blade on the normal plane along the rotation axis;

an included angle between the first line and the second line is a wrap angle θ; and the wrap angle θ between the first line and the second line for any point on the curve satisfies $\theta \in [0°, 40°]$.

* * * * *